US009252007B2

(12) United States Patent
Matsumoto et al.

(10) Patent No.: US 9,252,007 B2
(45) Date of Patent: Feb. 2, 2016

(54) LIGHT SOURCE DEVICE, METHOD FOR MANUFACTURING THE SAME AND FILAMENT

(71) Applicant: STANLEY ELECTRIC CO., LTD., Meguro-ku, Tokyo (JP)

(72) Inventors: Takahiro Matsumoto, Yokohama (JP); Shigemi Suzuki, Tsukuba (JP)

(73) Assignee: STANLEY ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/033,334

(22) Filed: Sep. 20, 2013

(65) Prior Publication Data

US 2014/0084785 A1 Mar. 27, 2014

(30) Foreign Application Priority Data

Sep. 21, 2012 (JP) ..... 2012-208735

(51) Int. Cl.
*H01K 1/10* (2006.01)
*H01K 3/02* (2006.01)
*H01K 5/00* (2006.01)

(52) U.S. Cl.
CPC .. *H01K 1/10* (2013.01); *H01K 3/02* (2013.01); *H01K 5/00* (2013.01)

(58) Field of Classification Search
CPC .... H01K 1/04–1/08; H01K 1/10; H01K 1/14; H01K 3/02
USPC ..... 313/345, 569, 578, 579, 315, 316; 419/4; 427/111; 428/368, 607; 445/48, 445/27
See application file for complete search history.

(56) References Cited

U.S. PATENT DOCUMENTS

| | | | | |
|---|---|---|---|---|
| 1,854,970 | A | 4/1932 | Agte | |
| 1,889,598 | A * | 11/1932 | Force | 313/341 |
| 1,925,857 | A * | 9/1933 | Van Liempt | 313/578 |
| 3,022,439 | A | 2/1962 | Cooper, Jr. et al. | |
| 4,196,368 | A * | 4/1980 | Hauer | 313/345 |
| 5,079,473 | A | 1/1992 | Waymouth | |
| 5,896,007 | A * | 4/1999 | Dobiasch et al. | 313/578 |
| 2002/0125806 | A1 | 9/2002 | Sugimura et al. | |
| 2006/0132014 | A1 | 6/2006 | Horiuchi et al. | |

(Continued)

FOREIGN PATENT DOCUMENTS

| | | | |
|---|---|---|---|
| GB | 1074203 | A | 6/1967 |
| GB | 2 032 173 | A | 4/1980 |

(Continued)

OTHER PUBLICATIONS

Partial European Search Report (ESR) dated Feb. 19, 2014 (in English) in counterpart European Application No. 13020104.9.

(Continued)

*Primary Examiner* — Anh Mai
*Assistant Examiner* — Steven Horikoshi
(74) *Attorney, Agent, or Firm* — Holtz, Holtz & Volek PC

(57) ABSTRACT

A filament using a high melting point metal compound such as tantalum carbide is provided. As the filament, a filament comprising a tungsten base material, a tantalum layer coating the tungsten base material, and a tantalum carbide layer coating the tantalum layer is used. The tantalum layer and the tantalum carbide layer may be replaced with a hafnium layer and a hafnium carbide layer, respectively, or may be formed of a combination of tantalum and hafnium.

14 Claims, 8 Drawing Sheets

(56) References Cited

U.S. PATENT DOCUMENTS

| | | | | |
|---|---|---|---|---|
| 2009/0045742 | A1* | 2/2009 | Bunk et al. | 313/578 |
| 2010/0327731 | A1* | 12/2010 | Aurongzeb et al. | 313/316 |
| 2014/0084785 | A1 | 3/2014 | Matsumoto et al. | |
| 2014/0292188 | A1 | 10/2014 | Matsumoto | |
| 2014/0361675 | A1 | 12/2014 | Matsumoto | |

FOREIGN PATENT DOCUMENTS

| | | | |
|---|---|---|---|
| JP | 55041663 | A | 3/1980 |
| JP | 55-72357 | A | 5/1980 |
| JP | 60147154 | U | 9/1985 |
| JP | 03102701 | A | 4/1991 |
| JP | 04349338 | A | 12/1992 |
| JP | 06-087656 | A | 3/1994 |
| JP | 08-064110 | A | 3/1996 |
| JP | 2002334649 | A | 11/2002 |
| JP | 2004158319 | A | 6/2004 |
| JP | 2005-068002 | A | 3/2005 |
| WO | 2005/052987 | A1 | 6/2005 |

OTHER PUBLICATIONS

F. Kusunoki, et al., "Narrow-Band Thermal Radiation with Low Directivity by Resonant Modes inside Tungsten Microcavities", Japanese Journal of Applied Physics, vol. 43, No. 8A, 2004, pp. 5253-5258 (in English).

Related U.S. Appl. No. 14/354,557; First Named Inventor: Takahiro Matsumoto; Title: "Incandescent Bulb, Filament, and Method for Manufacturing Filament"; filed Apr. 25, 2014.

* cited by examiner

W wire

Ta deposition

Coil Fabrication

TaC/Ta2C/W $$P_i(T) = \rho \Delta \theta$$

$$P_o(T) = (\rho + 2r) \Delta \theta$$

LIGHT SOURCE DEVICE, METHOD FOR MANUFACTURING THE SAME AND FILAMENT

TECHNICAL FIELD

The present invention relates to a light source device that utilizes a filament showing improved energy utilization efficiency.

BACKGROUND ART

There are widely used incandescent light bulbs which produce light with a filament such as tungsten filament heated by an electric current flown through it. Incandescent light bulbs have various advantages, for example, (a) they are inexpensive, (b) they show superior color rendering properties, (c) they can be used with any operating voltage (they can work with either alternating current or direct current), (d) they can be lightened with a simple lighting implement, (e) they are used worldwide, and so forth. However, efficiency of incandescent light bulbs for conversion from electric power to visible light is about 15 lm/W, which is lower than that of fluorescent lamps (conversion efficiency, 90 lm/W), and therefore they impose larger environmental loads.

Patent document 1 suggests use of tantalum carbide having a higher melting point than that of tungsten for the filament. Patent document 1 discloses a method for producing a sintered body of a carbon compound containing tantalum carbide, which comprises mixing impalpable powder TaC, powdery carbide of Zr, Hf, or the like, and the like, molding the mixture, and heating the molded body at a temperature of 1600° C. or higher.

Patent document 2 discloses a method for manufacturing a coil-shaped tantalum carbide electrode. In this manufacturing method, tantalum is first processed into a coil shape, this coil is subjected to a heat treatment to remove the surface oxide film, and after a carbon source is introduced, the coil is further subjected to a heat treatment. Carbon is thereby made to permeate into the tantalum from the surface to form a coil-shaped electrode fully consisting of tantalum carbide or consisting of tantalum carbide and tantalum.

Patent document 3 discloses that if a TaC film is formed on a surface of a tungsten filament by an ion-plating method, superior heat resistance and stable thermionic or field emission current can be obtained.

PRIOR ART REFERENCES

Patent Documents

Patent document 1: Japanese Patent Unexamined Publication (KOKAI) No. 6-87656

Patent document 2: Japanese Patent Unexamined Publication (KOKAI) No. 2005-68002

Patent document 3: Japanese Patent Unexamined Publication (KOKAI) No. 8-64110

SUMMARY OF THE INVENTION

Object to be Achieved by the Invention

It is difficult to obtain tantalum carbide of a desired shape by a method of molding powder and sintering the molded body such as the method of Patent document 1. A method of obtaining a tantalum carbide coil by carbonizing a part or all of a tantalum coil such as the method of Patent document 2 has a problem that the produced coil easily breaks, and disconnection is easily occurs, since tantalum carbide is brittle. Further, a method of forming a tantalum carbide film on a surface of a tungsten filament such as the method of Patent document 3 has a problem that adhesion between tungsten and the tantalum carbide film is poor, and thus the tantalum carbide film easily separates.

An object of the present invention is to obtain a filament that shows high luminous efficiency, and hardly causes disconnection and separation of film by utilizing a high melting point metal compound such as tantalum carbide.

Means for Achieving the Object

In order to achieve the aforementioned object, the light source device provided by the present invention comprises a light-transmitting gas-tight container, a filament disposed in the light-transmitting gas-tight container, and a lead wire for supplying an electric current to the filament, and the filament comprises a tungsten base material, a tantalum layer coating the tungsten base material, and a tantalum carbide layer coating the tantalum layer.

Effect of the Invention

In the present invention, a tantalum layer is disposed on the surface of tungsten by utilizing superior adhesion of tungsten and tantalum, and a tantalum carbide layer is formed on the surface of the tantalum layer. Superior adhesion is thereby obtained at the interface of tungsten and the tantalum layer, and the interface of the tantalum layer and the tantalum carbide layer, and the films hardly separate at the interfaces. A filament showing high input electric power-to-visible light conversion efficiency and hardly causing disconnection and separation of film can be thereby obtained.

MODES FOR CARRYING OUT THE INVENTION

In the present invention, a filament comprising a tungsten base material, a tantalum layer coating the tungsten base material, and a tantalum carbide layer coating the tantalum layer is used as a filament of a light source device. Although tantalum carbide has a high melting point and shows superior luminous efficiency, it is hard and brittle, and therefore if a filament is constituted with tantalum carbide alone, it easily breaks, and if a tantalum carbide film is formed on a certain base material, it easily causes film separation. According to the present invention, a tantalum layer is disposed on the surface of tungsten by utilizing superior adhesion of tungsten and tantalum, and a tantalum carbide layer is formed on the surface of the tantalum layer. Superior adhesion is thereby obtained at the interface of tungsten and the tantalum layer. The tantalum layer and the tantalum carbide layer also show superior adhesion, and therefore they hardly cause film separation at the interface thereof. Further, since tungsten is a material showing good workability, it can be processed into a desired shape by subjecting it to a desired processing such as winding before a carbonization treatment.

The tantalum carbide layer may be constituted with two or more layers, and it may have a configuration that the outermost layer is the TaC layer, and a $Ta_2C$ layer is provided so as to be closer to the tantalum layer than the TaC layer. The ratio of carbon is thereby made higher at a position closer to the tantalum carbide surface, and therefore separation of the tantalum layer and the tantalum carbide layer at the interface can be still more effectively prevented.

The tantalum carbide layer can be formed by subjecting the surface of the tantalum layer to a carbonization treatment. Adhesion of the tantalum layer and the tantalum carbide can be thereby improved.

The tantalum carbide layer constituting the surface of the filament preferably has a surface roughness (center line average roughness Ra) of 1 μm or smaller. Since light reflectance of the surface of the tantalum carbide layer of the filament can be thereby made larger for the infrared wavelength region, radiation rate for the infrared wavelength region and longer wavelength region can be suppressed, and much of input energy can be converted into visible light components.

A specific example of the present invention will be explained with reference to the drawings.

Figure 1:
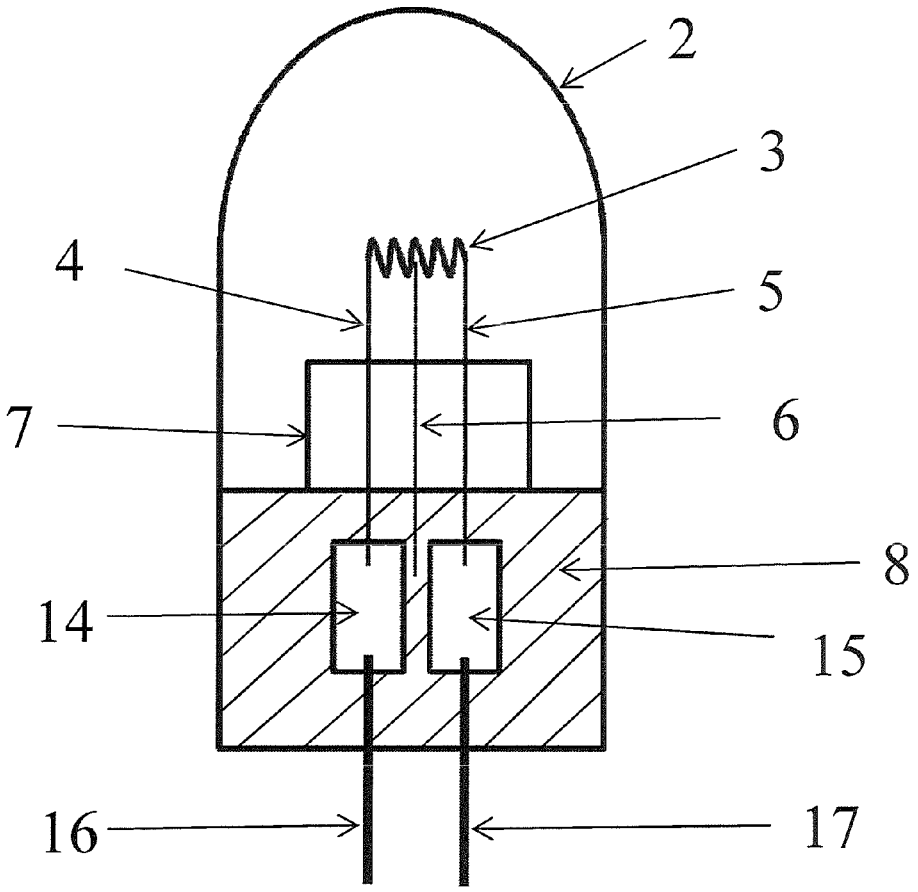
FIG. 1 is a cut-out sectional view of an exemplary incandescent light bulb.

FIG. 1 shows a sectional view of an incandescent light bulb 1 as an example of the light source device of the present invention. The incandescent light bulb 1 is constituted with a light-transmitting gas-tight container 2, a filament 3 disposed in the inside of the light-transmitting gas-tight container 2, a pair of lead wires 4 and 5 electrically connected to the both ends of the filament 3 and supporting the filament 3, and an anchor 6 supporting the filament 3. The lead wires 4 and 5, and the anchor 6 are supported by an insulating mount 7 disposed in the light-transmitting gas-tight container 2. A base part of the mount 7 is supported by a sealing part 8 of the light-transmitting gas-tight container 2. In the sealing part 8, sealing metals (metal foils) 14 and 15, and lead bars 16 and 17 are disposed.

Lower ends of the lead wires 4 and 5 are welded to the sealing metals 14 and 15 consisting of metal foils, respectively. Upper ends of the lead bars 16 and 17 are welded to the sealing metals 14 and 15, respectively, and the lower ends thereof protrude out of the sealing part 8. The sealing part 8 has a structure that the sealing metals 14 and 15, the lower ends of the lead wires 4 and 5, and the upper ends of the lead bars 16 and 17 are fixed by pinch seal and welding (seal is attained by melting and flattening the glass). It is thereby made possible to supply an electric current to the filament 3 from the outside via the lead bars 16 and 17. The sealing metals 14 and 15 disposed in the sealing part are sealed by pinch seal in order to prevent breakage of the light-transmitting gas-tight container 2 (breakage of glass) when the filament is used at a high temperature of 3000K or higher. That is, the material of the light-transmitting gas-tight container 2 has a low thermal expansion rate, but the metal lead wires 4 and 5 and the metal lead bars 16 and 17 have a high thermal expansion rate, and therefore significant difference is generated between thermal expansions of them when the device is used at a high temperature. The sealing metals 14 and 15 ease the stress caused by the difference of thermal expansions with the thickness and physical properties of the material thereof.

<Filament 3>

Figure 2:
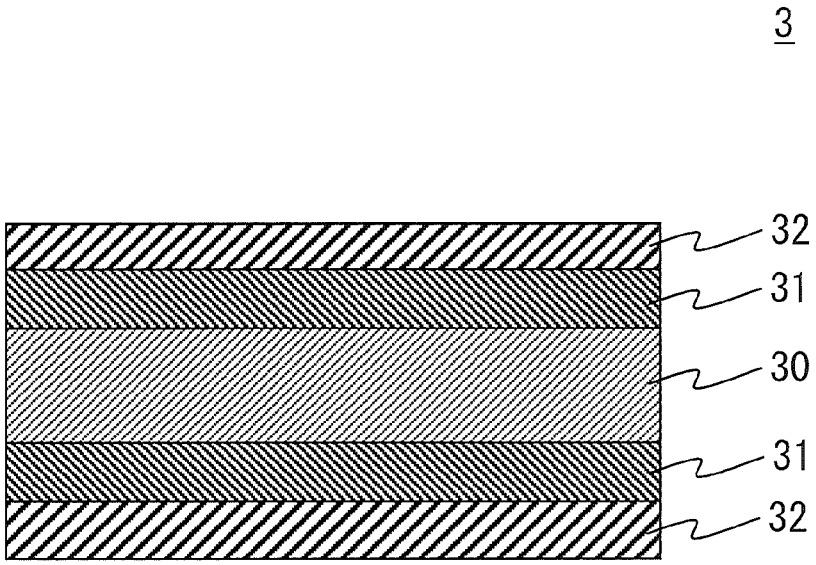
FIG. 2 is a sectional view of an exemplary filament along the axial direction.

The structure of the filament 3 will be explained with reference to FIG. 2. FIG. 2 is a sectional view of the filament 3 along the long axis direction. The filament 3 comprises a tungsten base material 30 in the form of a wire, a tantalum layer 31 coating the tungsten base material 30, and a tantalum carbide layer 32 coating the tantalum layer 31. Since the tungsten base material 30 and the tantalum layer 31 show good adhesion, film separation hardly occurs at the interface. Further, since tungsten shows good workability, the filament 3 can be processed into a desired shape. In this example, the filament 3 is wound spirally (in the form of coil).

The tantalum carbide layer 32 has hard and brittle properties, but shows good adhesion to the tantalum layer 31. Therefore, by disposing the tantalum carbide layer 32 so that the tantalum layer 31 is provided between the tungsten base material 30 and the tantalum carbide layer 32, the hard and brittle tantalum carbide layer 32 can be disposed with good adhesion.

The tantalum carbide layer 32 can be formed by subjecting the surface of the tantalum layer 31 to a carbonization treatment. Adhesion between the tantalum carbide layer 32 and the tantalum layer 31 can be thereby further improved.

The tantalum carbide layer 32 is preferably constituted with two or more layers. In such a case, it may have a structure that the outermost layer is constituted with the TaC layer, and a $Ta_2C$ layer is provided so as to be closer to the tantalum layer than the TaC layer. The TaC layer having a high melting point and showing high luminous efficiency can be thereby disposed as the outermost layer, and adhesion between the tantalum layer 31 and the tantalum carbide layer 32 can be further improved with the $Ta_2C$ layer having a lower carbon content than that of the TaC provided between the tantalum layer 31 and the tantalum carbide layer 32.

The filament 3 can provide high luminous efficiency, if the surface thereof is coated with the tantalum carbide layer 32. The tantalum carbide layer 32 preferably has a thickness of 10 to 100 μm. The tantalum layer 31 preferably has a thickness of 0.1 to 10 μm. Diameter of the tungsten base material 30 is set to be, for example, 10 to 100 μm.

As described above, the filament 3 of this example can be obtained as a filament hardly causing disconnection and film separation by using a high melting point metal compound, tantalum carbide, together with the tungsten base material 30 and the tantalum layer.

Figure 3A:
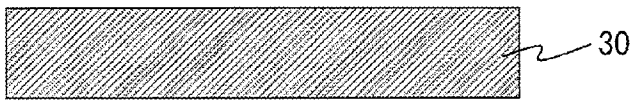
FIGS. 3A to 3D are explanatory drawings showing the manufacturing process of the exemplary filament.

Hereafter, the method for manufacturing the filament 3 will be explained with reference to FIGS. 3A to 3D. First, the tungsten base material 30 in the form of wire is prepared as shown in FIG. 3A, placed in a vacuum chamber, and heated to 1500 to 2000° C. in vacuum to remove oxide film of $WO_2$ etc. adhering to the surface of the tungsten base material 30. The section of the tungsten base material 30 in the form of wire perpendicular to the long axis direction may be in a desired shape (circular shape or rectangular shape). FIG. 3C shows a case where the sectional shape is a rectangular shape as an example. When the tungsten base material 30 is heated, by evaluating the surface temperature of the tungsten base material 30 through measurement of thermal spectrum for the heat emitted from the surface of the tungsten base material 30 with a radiation thermometer, it can be confirmed whether the oxide film of $WO_2$ etc. is totally removed. Specifically, the oxide film of $WO_2$ etc. has a lower sublimation temperature compared with actual temperature of the tungsten base material 30, and if the surface oxide film is totally removed, and W metal of the tungsten base material 30 is exposed, the temperature of the surface of the tungsten base material 30 becomes higher. By observing this temperature elevation, whether the oxide film is totally removed can be confirmed.

Figure 3B:
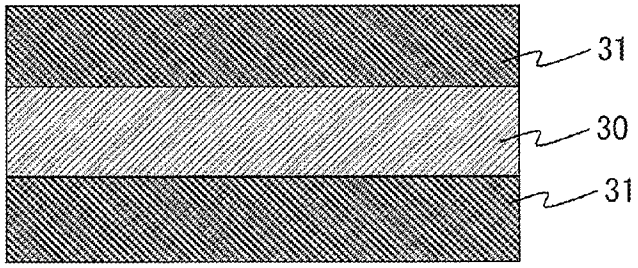
Figure 3C:
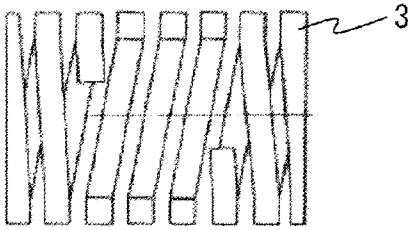
Figure 3D:
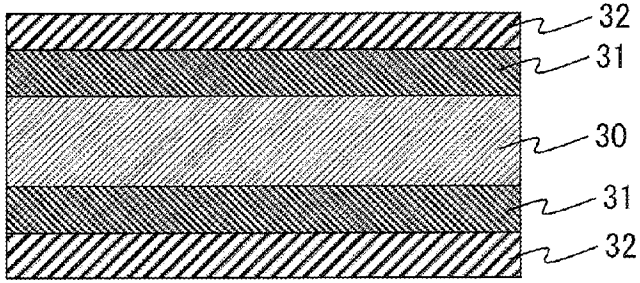

Then, by using such a technique as electron beam deposition and sputtering deposition, Ta metal is deposited on the surface of the tungsten base material 30 in a thickness of 0.1 to 10 μm to form the tantalum layer 31 (FIG. 3B).

Then, as shown in FIG. 3C, the tungsten base material 30 on which the tantalum layer 31 has been formed is wound in the shape of a coil. The tantalum carbide layer 32 formed in the following step is hard and brittle, but by processing the tungsten base material 30 into a coil before the carbonization treatment step, generation of cracks in the tantalum carbide layer 32 and film separation can be prevented. The tungsten base material 30 may be wound into a coil shape before the step of forming the tantalum layer 31 (FIG. 3B), and then the tantalum layer 31 may be formed.

In order to remove the oxide film of TaO etc. on the surface of the tantalum layer 31, the tungsten base material 30 having the tantalum layer 31 is placed in a vacuum chamber, and heated at 1500 to 2000° C. in vacuum again. The oxide film of TaO etc. adhering to the surface of the tantalum layer 31 can be thereby removed, and tantalum can be exposed. Also at the time of this heating, by measuring the surface temperature of the tantalum layer 31 with a radiation thermometer, whether the oxide film is totally removed can be confirmed.

Subsequent to the step of removing the oxide film, the surface of the tantalum layer 31 is subjected to a carbonization treatment to form a TaC layer. The carbonization treatment is performed by introducing a carbon source such as methane or ethane gas at a temperature of 1200 to 2000° C. into the vacuum chamber. Carbon is thereby made to permeate from the surface of the tantalum layer 31 (carburization treatment) to convert a surface layer of the tantalum layer 31 into a tantalum carbide layer 32. In this carbonization treatment, degree of carbonization can be controlled for the film thickness direction by adjusting time of the carburization treatment. There can be thereby formed, for example, the tantalum carbide layer 32 of which outermost surface consists of TaC, and the degree of carbonization is gradually lowered from the surface for the film thickness direction. By forming the tantalum carbide layer 32 of which carbon concentration varies for the film thickness direction as described above, the problem that the tantalum carbide layer 32 and the tantalum layer 31 are separated by the thermal stress resulting from the difference in thermal expansion coefficients can be avoided.

Further, by making unevenness of the surface of the tungsten carbide layer 32 of the filament 3 smaller to increase reflectance of the surface for the infrared wavelength region or longer wavelength region, the luminous efficiency of the filament 3 can be further improved. Specifically, surface roughness (center line average roughness) Ra thereof is preferably 1 μm or smaller.

Figure 4:
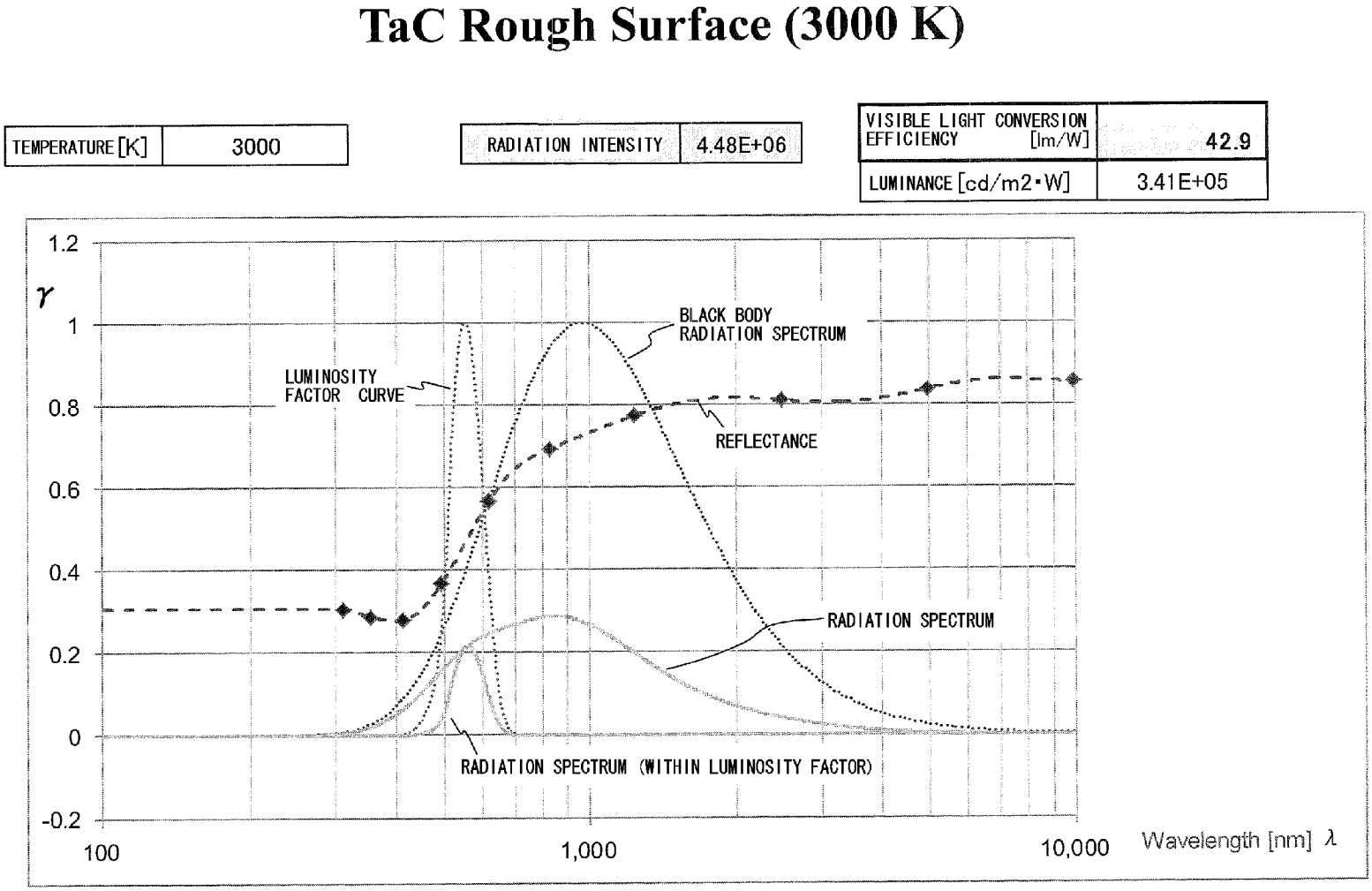
FIG. 4 is a graph showing a reflectance curve and radiation spectra of tantalum carbide having a rough surface at a temperature of 3000K.

Surface roughness of tungsten in the form of wire (tungsten base material 30) produced by a general manufacturing process is large, and the center line average roughness Ra thereof is larger than 1 μm. Even in the case of forming the tantalum layer 31 and the tantalum carbide layer 32, unevenness of the surface of the tungsten base material 30 is reflected in unevenness of the surface of the tantalum carbide layer 32. Reflectance ($\gamma(\lambda)$, $\lambda$ represents wavelength) of the tantalum carbide layer having a large surface roughness is shown in FIG. 4. Spectral emissivity $\epsilon(\lambda)$ can be calculated in accordance with the equation $\epsilon(\lambda)=1-\gamma(\lambda)$ according to the Kirchhoff's law. In FIG. 4, the radiation spectrum, black body radiation spectrum (3000K), luminosity factor curve, and radiation spectrum within luminosity factor of tantalum carbide are shown together. The radiation spectrum of tantalum carbide was obtained by multiplying the Spectral emissivity $\epsilon(\lambda)$ with the black body radiation spectrum of tantalum carbide. The radiation spectrum of tantalum carbide within luminosity factor was obtained by multiplying the luminosity factor curve with the radiation spectrum of tantalum carbide.

Loss of energy P(radiation) due to thermal radiation to the outer space from this tantalum carbide can be obtained according to the following equation (1).

[Equation 1]

$$P(\text{Radiation}) = \int_0^\infty \varepsilon(\lambda)\frac{\alpha\lambda^{-5}}{\exp(\beta/\lambda T)-1}\,d\lambda \tag{1}$$

In the equation (1), $\epsilon(\lambda)$ is spectral emissivity for each wavelength as described above, $\alpha\lambda^{-5}/(\exp(\beta/\lambda T)-1)$ is the Planck's law of radiation, $\alpha=3.747\times10^8$ Wμm4/m$^2$, and $\beta=1.4387\times10^4$ μmK.

If radiation energies of tantalum carbide for the total wavelength region and the visible region are calculated in accordance with the equation (1), and the ratio of them is defined as visible light conversion efficiency, visible light conversion efficiency (luminous efficiency) of tantalum carbide having a rough surface is 43 lm/W at a temperature of about 3000K.

Roughness of the surface of the tantalum carbide layer 32 can be made smaller by making the surface of the tungsten base material 30 into a mirror surface using mechanical polishing or the like. The reflectance for at least the infrared wavelength region and longer wavelength region can be thereby made larger, and the radiation rate for the infrared wavelength region and longer wavelength region can be suppressed. It can be thereby made possible to convert more input energy into visible light components.

It is desirable to polish the tungsten base material 30 so that, for example, the reflectance of the tantalum carbide layer 32 for the infrared wavelength region of a wavelength of 3 μm or longer become 0.9 or larger, and the reflectance of the same for the visible light wavelength region of a wavelength of 0.7 μm or shorter become 0.75 or smaller. The center line average roughness Ra of the tantalum carbide layer 32 is preferably 1 μm or smaller, particularly preferably 0.5 μm or smaller. The center line average roughness Ra referred to here is measured with a contact surface roughness meter.

The relationship of the center line average roughness Ra and the reflectance $\gamma(\lambda)$ can be qualitatively described as the following equation (2) for the region of roughness of 5 μm or smaller.

$$\gamma(\lambda)=1-\alpha(\lambda)Ra \tag{2}$$

In the equation, $\alpha(\lambda)$ is a shape factor correlating the center line average roughness Ra according to wavelength and type of material and the reflectance $\gamma(\lambda)$. It dose not greatly depend on the material concerning the metal material used for the invention, and it has a value of about 0.1 to 0.2 (μm$^{-1}$) for a wavelength of 3 μm.

Figure 5:
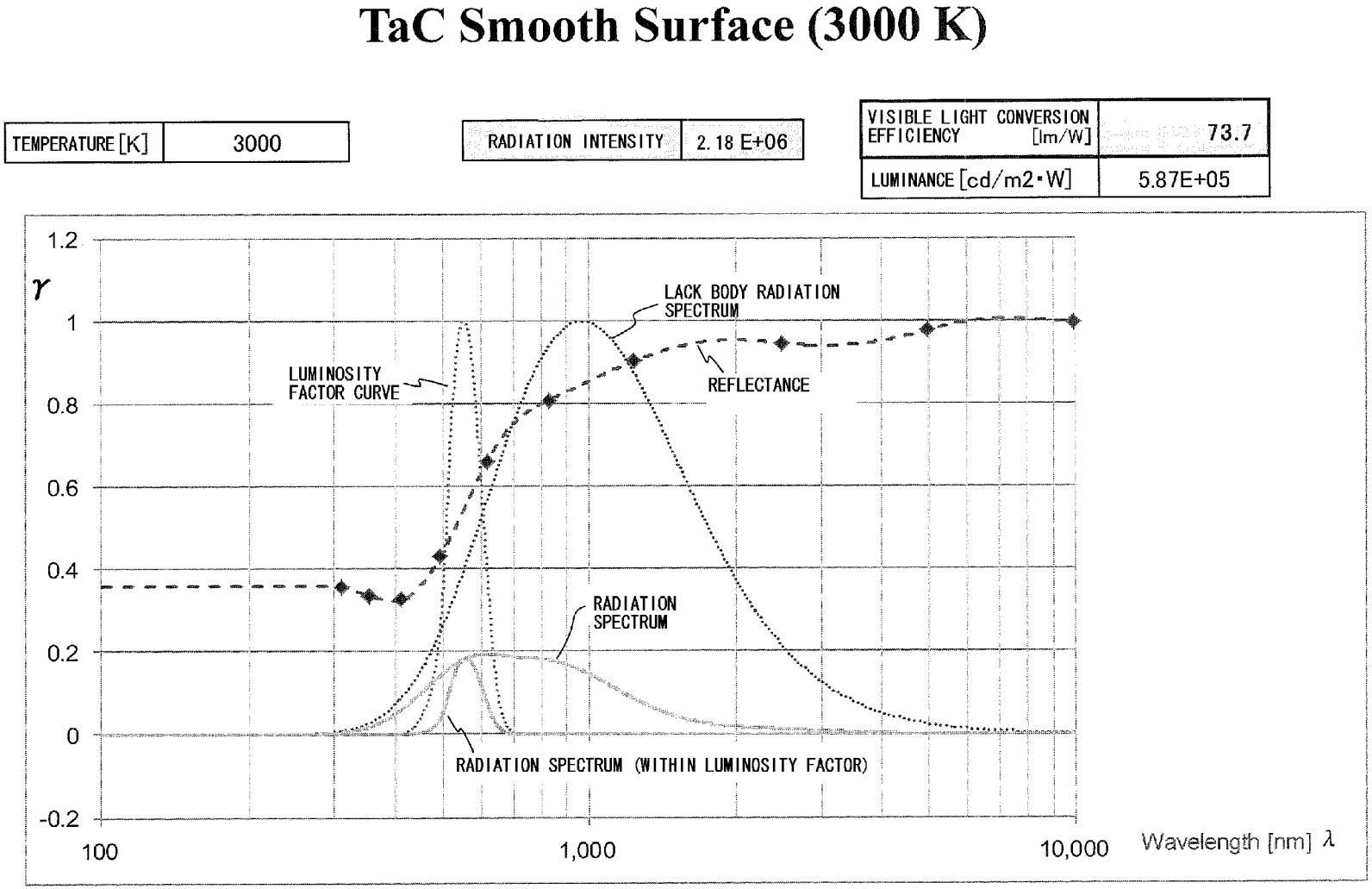
FIG. 5 is a graph showing a reflectance curve and radiation spectra of tantalum carbide having a mirror surface at a temperature of 3000K.

If the tungsten base material 30 is polished with two or more kinds of diamond polishing grains so that the center line average roughness Ra of the tantalum carbide layer 32 formed thereon becomes 0.2 μm or smaller, the maximum value of the reflectance can be improved to be 0.98 or smaller, as shown in FIG. 5. The radiation rate of the tantalum carbide layer 32 for the infrared region of a wavelength of 3 μm or longer is thereby suppressed compared with a case of the tantalum carbide layer 32 having a large surface roughness, and the infrared component of radiation spectrum becomes suppressed as shown in FIG. 5. The visible light conversion efficiency of the filament calculated by using the spectral emissivity of the tantalum carbide layer 32 having the surface roughness Ra of 0.2 μm or smaller is 74 lm/W at 3000K, and thus the visible light conversion efficiency can be made 1.7 times of that of the tantalum carbide layer 32 having a larger surface roughness at the same temperature, 43 lm/W.

As described above, in this example, the surface of the tungsten base material 30 can be polished to increase the reflectance of the tantalum carbide layer 32 to be formed thereon, and therefore the visible light conversion efficiency of the filament 3 can be further enhanced.

Further, although the reflectance of the surface of the tantalum carbide layer 32 was improved by a mechanical polishing treatment of the tungsten base material 30 in the aforementioned example, the present invention is not limited to such a method. It is also possible to choose the method and conditions for film formation at the time of forming the tantalum layer 31 to form the tantalum layer 31 having a smooth surface, and subject the surface layer to a carbonization treatment to form the tantalum carbide layer 32 having a surface roughness Ra of 1 μm or smaller. Further, it is also possible to combine this method and the polishing treatment of the tungsten base material 32. Furthermore, it is also possible to employ a method of adjusting the conditions for drawing and forging of the tungsten base material 30, a method of reducing the surface roughness of the tungsten base material 30 by contacting the surface thereof to a smooth mold at the time of rolling, or a method of performing wet or dry etching of a surface of at least one of the tungsten base material 30, the tantalum layer 31, and the tantalum carbide layer 32 to convert the surface into a mirror surface.

The shape of the filament 3 in the form of a coil is preferably defined so that the adjacent parts of the coil do not contact with each other even when the filament is deformed by heating at a high temperature. Hereafter, this characteristic will be explained with reference to FIGS. 6 and 7.

Since the melting point of the tantalum carbide layer 32 is as high as 4250K, the filament 3 can be heated to a temperature near the melting point of the tungsten base material (3700K). At such a high temperature, the coefficient of thermal expansion and elastic constant of the filament 3 change, and there is observed a phenomenon that a part of the filament not supported by the lead wires 4 and 5 or the anchor 6 deflects to hang down in the gravity direction. Therefore, parts of the coil (each corresponding to one cycle of winding of the filament) on the side of internal circumference of the deflection approach each other in proportion to the degree of the deflection, and may contact with each other. Accordingly, the coil pitch must be designed so that adjacent parts of the coil should not contact with each other, even when the deflection is generated.

Figure 6:
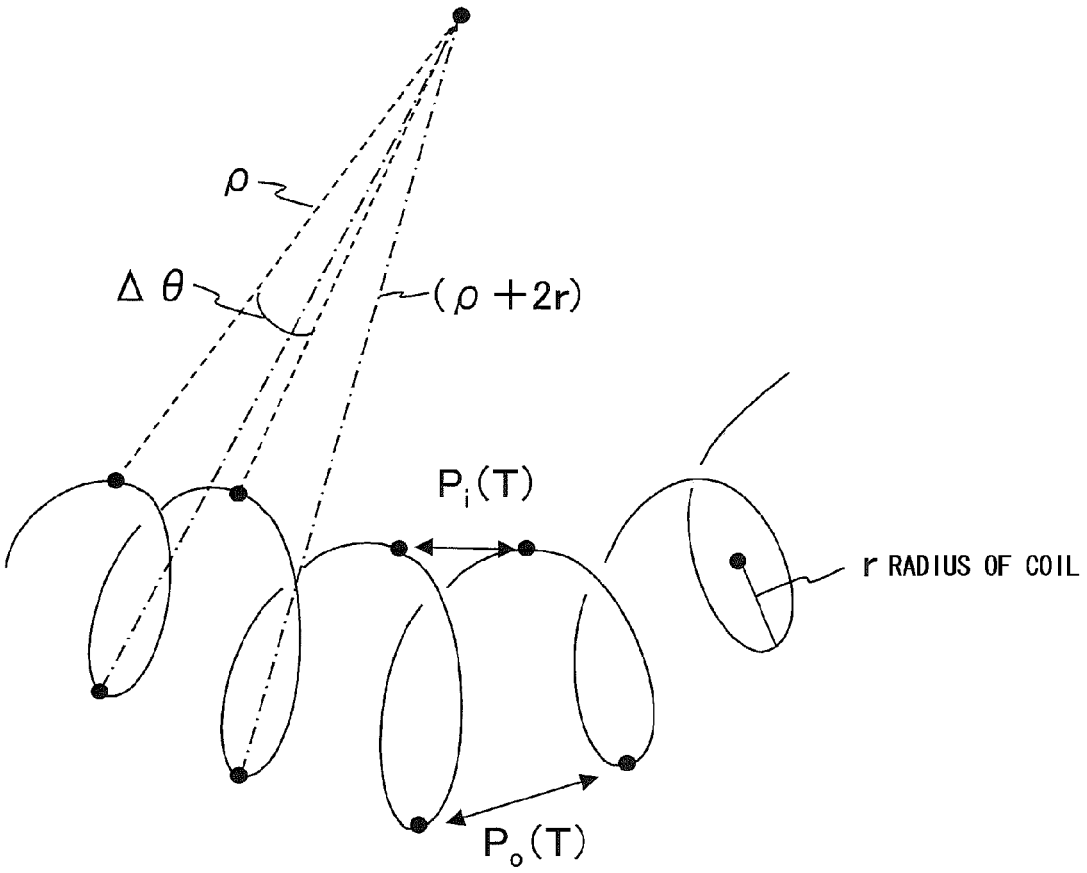
FIG. 6 is an explanatory drawing showing a shape of the exemplary filament 3, which is deflected.

The equation of motion of the filament 3 deflected as shown in FIG. 6 for each axis direction is represented by the equation (3).

$$M\partial^2 Xi/\partial t^2=\gamma i-\Sigma\kappa ij(\rho\cdot\Delta\theta)j \quad (3)$$

In the equation, Xi=(x, y, z), and γi=(0, 0, Mg). κij is a tensor representing the elastic constant of the filament 3, and the sum is obtained for the component direction j. Further, ρ is curvature radius of the deflection of the filament 3, and Δθ is angle of aperture of each part of the coil at the center of curvature of the deflection. M is density per unit volume of the filament 3. j in (ρ·Δθ)j of the right side represents coordinates of x, y, and z, and (ρ·Δθ)j represents amount of the deflection in the direction j.

In a static case, the equation (3) can be easily solved, and the coil pitch $P_i(T)$ on the internal circumference side of the deflection of the coil (side on which pitch becomes smaller) and the coil pitch $P_o(T)$ on the external circumference side of the deflection of the coil (side on which pitch becomes larger) are eventually represented by the following equations (4) and (5), respectively.

$$Pi(T)=P(1-\Delta) \quad (4)$$

$$P_o(T)=P(1+\Delta) \quad (5)$$

In the equations, Δ=α/κij(T) (6). P is coil pitch of the coil not deflected, and α is a constant defined with parameters including weight of the filament 3, length of the filament 3, coil pitch at a low temperature, etc. T represents coil temperature of the filament 3.

Figure 7:
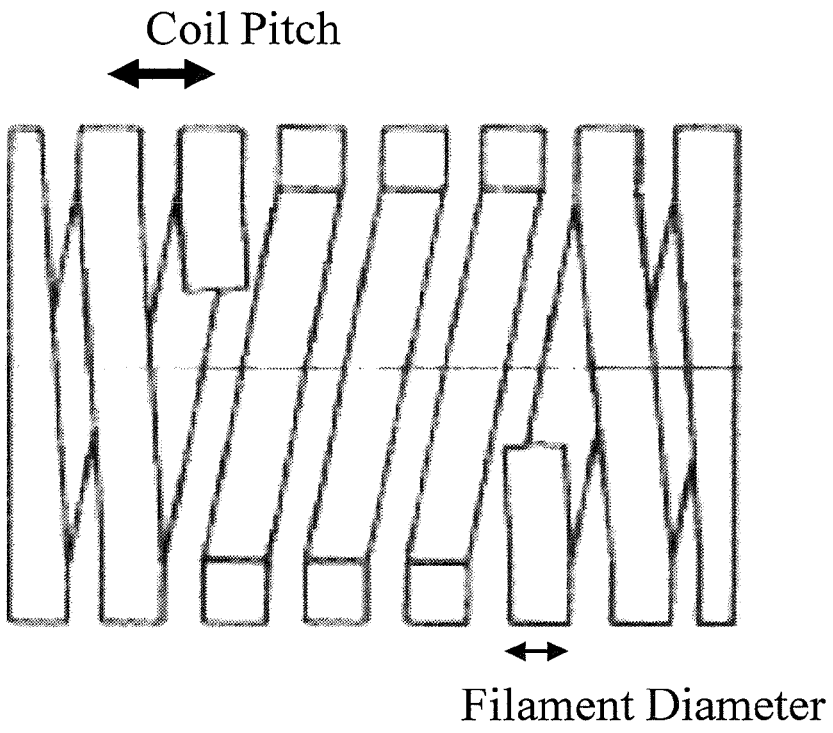
FIG. 7 is an explanatory drawing showing coil pitch and diameter of the exemplary filament 3.

The condition for maintaining adjacent parts of the coil of the filament 3 not to contact with each other at the time of heating at high temperature is represented by the equation (7), wherein D represents diameter of the filament 3 (diameter of wire) as shown in FIG. 7.

$$P_i(T)=P(1-\Delta)\geq D \quad (7)$$

Therefore, the coil pitch P is chosen so that the condition of the equation (7) is satisfied in consideration of the elastic modulus κij of the filament 3, and so forth. For example, in the case of a filament of tungsten, of which elastic constant is known well, the Young's modulus thereof is 410 GPa at room temperature, but at 3000K, the Young's modulus is 200 GPa, i.e., the Young's modulus reduces by about 50%. The condition for maintaining adjacent parts of the coil not to contact with each other even when the coil is deflected at high temperature is P≥2D. That is, when the coil is not supported by the anchor 6, the coil pitch P must be at least two times of the diameter D of the wire of the filament or larger. In the case of the filament formed with tantalum carbide (TaC), the Young's modulus thereof is 560 GPa at room temperature, but the Young's modulus reduces by about 30% at 4000K, and therefore the condition for maintaining adjacent parts of the coil not to contact with each other even when the coil is deflected at high temperature is P≥1.5D. That is, when the coil is not supported by the anchor 6, the coil pitch P must be at least 1.5 times of the diameter D of the wire of the filament or larger.

Since the filament 3 of this example has a multi-layer structure comprising the tantalum layer 31 and the tantalum carbide layer 32 on the tungsten base material 30, the coil pitch P is designed in consideration of the elastic modulus of the whole multi-layer structure etc.

<Lead Wire>

Since the melting point of the tantalum carbide layer 32 in the filament 3 of the incandescent light bulb of this example is 4250K (when it consists of TaC), the filament 3 can be heated to a temperature around 3700K, which is the melting point of the tungsten base material 30. Therefore, as the material of the lead wires 4 and 5 for flowing an electric current into the filament 3 at such an extremely high temperature, a high melting point metal must be used. For example, Mo wires can be used as the lead wires 4 and 5.

<Anchor 6>

The anchor 6 supporting the filament 3 contacts with the filament 3 of high temperature. Therefore, if a usual refractory metal (W, Ta, etc.) is used, carbon in the TaC layer 32 at the surface of the filament 3 may migrate into the metal constituting the anchor 6 to cause partial reduction of carbon in the filament 3, which may result in melt fracture of the filament 3. Therefore, the tip end part of the anchor 6, which contacts with the filament 3, is desirably carbonized beforehand. Specifically, it is preferable to use a metal wire consisting of Ta, Hf or the like as the anchor 6, and carbonize the part thereof to be contacted with the filament 3 beforehand.

<Enclosed Gas>

In order to prevent sublimation of the filament 3 even when it is heated to a temperature near the melting point of tungsten, it is desirable to enclose a gas in an internal space 12 of the light-transmitting gas-tight container 2 at a pressure not lower than 1 Pa and as high as possible. As for type of the enclosed gas, nitrogen or an inert gas species (argon, krypton, or xenon) is preferred.

Further, for preventing reduction of carbon in the tantalum carbide layer 32 at the surface of the filament 3 when the filament 3 is heated to a high temperature, it is effective to add carbon to the gas to be enclosed in the internal space 12 of the light-transmitting gas-tight container 2 to utilize cycle of carbon. Specifically, the following additives are added to inert gas as the enclosed gas at the following ratios: additives, 0.1 to 5 mol % of hydrocarbon ($CH_4$, $C_2H_6$, $C_2H_4$, $C_2H_2$, etc.), 0.2 to 20 mol % of hydrogen, and 0.05 to 0.5 mol % of bromine (bromine compound, HBr, $Br_2$, $CH_3Br$, $C_2H_5Br$, etc.) or iodine (iodine compound, HI, $I_2$, $CH_3I$, $C_2H_5I$, etc.). The ratios of the additives (mol %) are ratios for an enclosing pressure of $10^5$ to $10^6$ Pa.

By introducing the enclosed gas as described above, blackening of the internal surface of the light-transmitting gas-tight container due to decarbonization and sublimation at high temperature can be avoided.

<Light-Transmitting Gas-Tight Container 2>

The light-transmitting gas-tight container 2 of the incandescent light bulb of the example contains the enclosed gas at high pressure, and temperature of the internal wall thereof also becomes as high as about 200 to 600° C., which is higher than that of incandescent light bulbs using usual tungsten filaments. Therefore, as the material of the light-transmitting gas-tight container 2, hard glass, aluminosilicate glass, or silica glass is preferably used.

In addition to the aforementioned characteristics, in the sealing part 8 in which the light-transmitting gas-tight container 2 seals the lead wires 4 and 5, the sealing metals 14 and 15 are preferably connected to the lower ends of the lead wires 4 and 5. The sealing metals 14 and 15 consist of metal foils, and are disposed in order to ease the stress induced by the difference in the thermal expansion coefficients of the material of the upper ends of the lead wires 4 and 5 (for example, Mo, high thermal expansion coefficient) and the material of the light-transmitting gas-tight container 2 (quartz glass, low thermal expansion coefficient). Thereby adhesion of the material of the light-transmitting gas-tight container 2 and the sealing metals 14 and 15 is stably maintained in the sealing part 8 at a high temperature, breakage of the light-transmitting gas-tight container 2 is prevented, and gas-tightness of the container is maintained for a long period of time. As the sealing metal 14 and 15, for example, Mo foil or platinum-cladded Mo foil can be used.

Further, as for the shape of the light-transmitting gas-tight container 2, it is preferred that the distance between the internal wall and the heat emission part of the filament 3 is not larger than 20 mm. This is because heat conduction loss due to convection of the gas generated in the light-transmitting gas-tight container 2 can be prevented, and favorable efficiencies of the aforementioned cycle of carbon and cycle of halogen can be obtained with the aforementioned distance not larger than 20 mm.

The tantalum carbide layer 32 easily causes the decarbonization phenomenon in the presence of moisture to cause marked blackening of the internal wall of the light-transmitting gas-tight container 2. Therefore, it is preferable to remove moisture present (absorbed) on the internal wall of the light-transmitting gas-tight container 2 by heating the light-transmitting gas-tight container 2 (300 to 600° C.) and evacuating the container by vacuum before enclosure of the gas.

<Radiation Characteristics of Filament 3>

Figure 8:
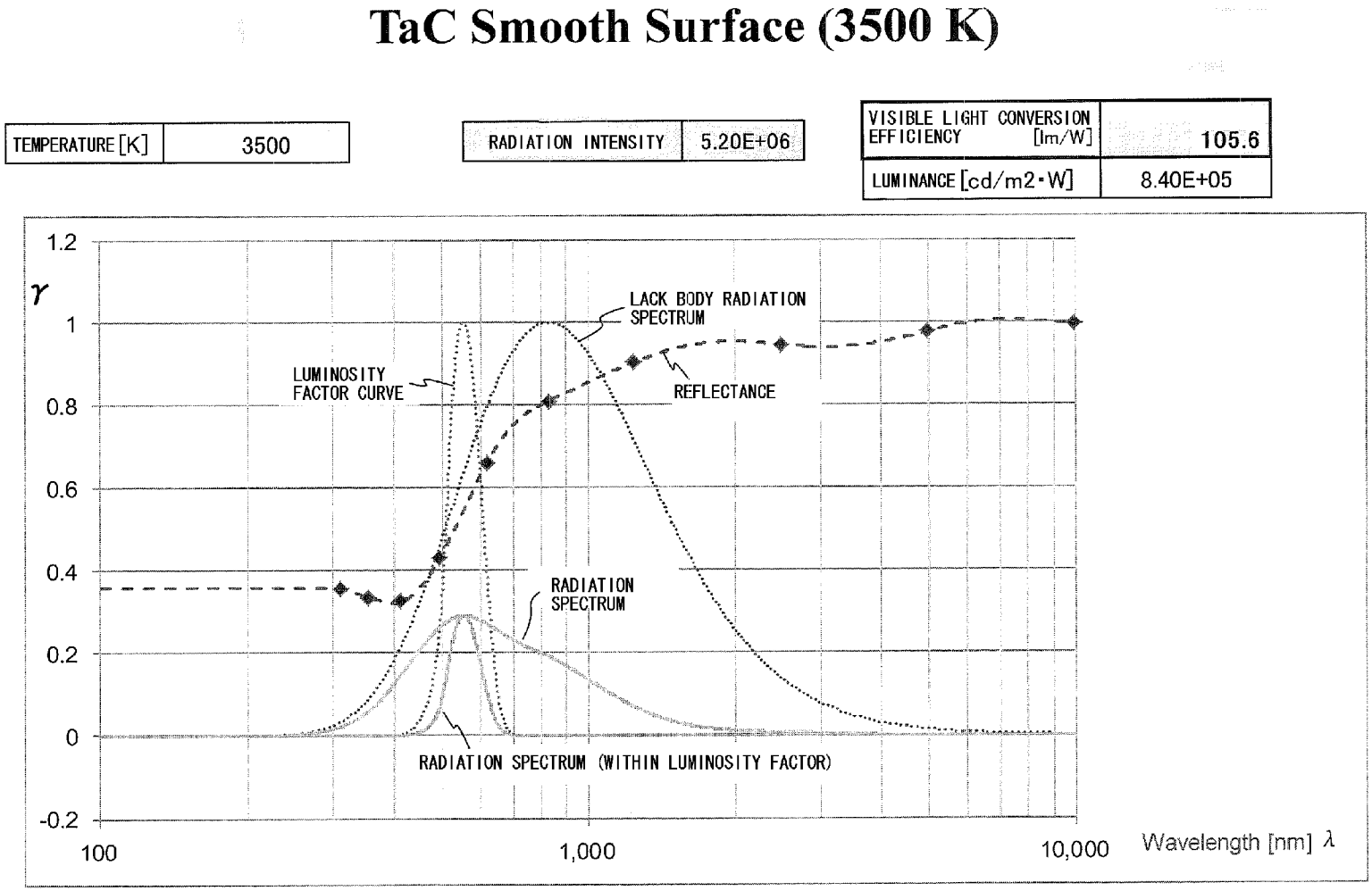
FIG. 8 is a graph showing a reflectance curve and radiation spectra of tantalum carbide having a mirror surface at a temperature of 3500K.

The radiation characteristics of tantalum carbide (TaC) at 3000K and 3500K are as shown in FIGS. 5 and 8. Not only that TaC can be heated to a high temperature, the radiation rate thereof for the infrared wavelength region is suppressed, and the radiation rate thereof for the visible region is large, as shown in FIG. 5. Therefore, the filament 3 of the example having the tantalum carbide layer 32 at the surface enables manufacture of electric bulbs showing a high visible light luminous efficiency. That is, higher spectral emissivity is realized at shorter visible wavelength region; on the other hand, infrared radiation is extremely suppressed at heating temperature of 3000 to 3500 K, thereby visible light conversion efficiency can be enhanced. For example, when the filament 3 having the tantalum carbide layer 32 (TaC) at the surface is heated to 3000K, a visible light conversion efficiency of about 74 lm/W can be obtained, and when it is heated to 3500K, a visible light conversion efficiency of about 106 lm/W can be obtained, as shown in FIG. 8. These values show the efficiencies 3 to 5 times higher than those of conventional tungsten halogen lamps (about 20 lm/W).

In the aforementioned example, the filament 3 having the tantalum carbide layer 32 is explained. However, by replacing tantalum with hafnium (Hf), a filament having a hafnium layer instead of the tantalum layer 31, and a hafnium carbide (HfC) layer instead of the tantalum carbide layer 32 can be manufactured. That is, a filament having a hafnium layer and a hafnium carbide layer in this order on the surface of the tungsten base material 30 can be manufactured. Such a filament can be manufactured according to the aforementioned manufacturing method of the filament 3 by using hafnium instead of tantalum as a source of film formation in the film formation step of the tantalum layer 31. The step of the carbonization treatment is performed in the same manner as that of the aforementioned manufacturing method of the filament 3.

Further, in the case of the filament constituted with HfC, the condition of the coil pitch P for preventing adjacent parts of the coil of the filament 3 from contacting with each other due to deflection is calculated as follows. The Young's modulus of HfC is 600 GPa at room temperature, but it reduces by about 30% at 4000K. Therefore, the coil pitch is preferably set so that the coil pitch P is 1.5D or larger. That is, when the filament is not supported by the anchor 6 or the like, the coil pitch P is preferably 1.5 times of the diameter D of the wire of the filament or larger. In addition, since the filament of this example is a filament having a multi-layer structure comprising the hafnium layer and the hafnium carbide layer in this order on the surface of the tungsten base material 30, not a filament consisting of HfC alone, the coil pitch is set in consideration of the Young's modulus of the whole multi-layer structure.

Further, a part of tantalum in the filament 3 of the aforementioned example may be replaced with hafnium (Hf). Specifically, there can be employed a structure of the filament comprising a tantalum-hafnium ($Ta_xHf_y$) layer instead of the tantalum layer 31 and a tantalum-hafnium carbide ($Ta_xHf_yC$) layer instead of the tantalum carbide layer 32. Such a filament can be manufactured according to the aforementioned manufacturing method of the filament 3 by simultaneously depositing tantalum and hafnium to form a tantalum-hafnium layer using tantalum and hafnium as a source of film formation in the film formation step of the tantalum layer 31. The step of the carbonization treatment is performed in the same manner as that of the aforementioned manufacturing method of the filament 3.

The incandescent light bulb using the filament of the present invention can be heated to a high temperature near the melting point of tungsten, and can be provided as an inexpensive energy-saving electric bulb for illumination showing improved visible light conversion efficiency compared with the conventional incandescent light bulbs and tungsten halogen lamps.

Further, since the work function p of both TaC and HfC is 3.4 eV, which is lower than the work function p of tungsten, 4.54 eV, it becomes possible to constitute a thermionic or field electron emission source of high intensity (used for X-ray tubes, electron microscopes, etc.) and so forth by utilizing two of the advantages, the low work function and high temperature resistance, according to the present invention.

That is, the filament of the present invention can be used not only for incandescent light bulbs, but also for other light source devices such as tungsten halogen lamps, as well as wires for heaters, electron radiation sources for X-ray tubes, electron guns for electron microscopes, and so forth.

DESCRIPTION OF NUMERICAL NOTATIONS

1 . . . Incandescent light bulb, 2 . . . light-transmitting gas-tight container, 3 . . . filament, 4 . . . lead wire, 5 . . . lead wire, 6 . . . anchor, 8 . . . sealing part.

The invention claimed is:

1. A light source device comprising a light-transmitting gas-tight container, a filament disposed in the light-transmitting gas-tight container, and a lead wire for supplying an electric current to the filament, wherein:

the filament comprises a tungsten base material, a tantalum layer coating the tungsten base material, and a tantalum carbide layer coating the tantalum layer;

the tungsten base material has a surface roughness, which is a center line average roughness Ra, of at most 1 μm; and the tantalum carbide layer at a surface of the filament has a surface roughness, which is a center line average roughness Ra, of at most 1 μm.

2. The light source device according to claim 1, wherein the tantalum carbide layer comprises at least two layers, wherein the outermost layer is a TaC layer, and a $Ta_2C$ layer is provided so as to be closer to the tantalum layer than the TaC layer.

3. The light source device according to claim 1, wherein the tantalum carbide layer is formed by subjecting a surface of the tantalum layer to a carbonization treatment.

4. The light source device according to claim 1, wherein the filament has a spirally wound structure having a winding pitch of at least 1.5 times the diameter of the filament.

5. The light source device according to claim 1, further comprising an anchor member for supporting the filament, and wherein:

a part of the anchor member to be contacted with the filament is carbonized.

6. The light source device according to claim 1, wherein a gas is enclosed in a space in the light-transmitting gas-tight container at a gas pressure of at least 1 Pa.

7. The light source device according to claim 6, wherein the gas contains a hydrocarbon gas.

8. The light source device according to claim 1, further comprising a lead wire for supplying an electric current to the filament, and wherein:

the lead wire is connected to a metal foil at a sealing part of the light-transmitting gas-tight container, and the metal foil is sealed with a transparent member constituting the light-transmitting gas-tight container.

9. A method for manufacturing the light source device of claim 1, the method comprising:

forming the tantalum layer on a surface of the tungsten base material, and forming the tantalum carbide layer at an outermost surface of the tantalum layer by subjecting a surface of the tantalum layer to a carbonization treatment.

10. A light source device comprising a light-transmitting gas-tight container, a filament disposed in the light-transmitting gas-tight container, and a lead wire for supplying an electric current to the filament, wherein:

the filament comprises a tungsten base material, a hafnium layer coating the tungsten base material, and a hafnium carbide layer coating the hafnium layer.

11. A light source device comprising a light-transmitting gas-tight container, a filament disposed in the light-transmitting gas-tight container, and a lead wire for supplying an electric current to the filament, wherein:

the filament comprises a tungsten base material, a tantalum hafnium ($Ta_xHf_y$) layer coating the tungsten base material, and a tantalum hafnium carbide ($Ta_xHf_yC$) layer coating the tantalum hafnium layer.

12. A filament comprising a tungsten base material, a tantalum layer coating the tungsten base material, and a tantalum carbide layer coating the tantalum layer, wherein the tungsten base material has a surface roughness, which is a center line average roughness Ra, of at most 1 μm, and wherein the tantalum carbide layer at a surface of the filament has a surface roughness, which is a center line average roughness Ra, of at most 1 μm.

13. A filament comprising a tungsten base material, a hafnium layer coating the tungsten base material, and a hafnium carbide layer coating the hafnium layer.

14. A filament comprising a tungsten base material, a tantalum-hafnium ($Ta_xHf_y$) layer coating the tungsten base material, and a tantalum-hafnium carbide ($Ta_xHf_yC$) layer coating the tantalum-hafnium layer.

* * * * *